United States Patent [19]

Surrendi

[11] Patent Number: 4,945,936

[45] Date of Patent: Aug. 7, 1990

[54] COLLAPSIBLE TENT AND FRAME THEREFOR

[76] Inventor: Dennis C. Surrendi, 2 Ironstone Place, St. Albert, Alberta, Canada, T8N 5J6

[21] Appl. No.: 394,481

[22] Filed: Aug. 16, 1989

[51] Int. Cl.[5] ..... E04H 15/28

[52] U.S. Cl. ..... 135/98; 135/104; 135/29; 135/102

[58] Field of Search ..... 135/101, 102, 104, 98, 135/27, 29, 31

[56] References Cited

U.S. PATENT DOCUMENTS

| | | | |
|---|---|---|---|
| 1,124,420 | 1/1915 | Gough . | |
| 1,666,757 | 4/1928 | Snyder . | |
| 2,357,056 | 8/1944 | Nelson | 135/104 |
| 3,000,386 | 9/1961 | Schulze et al. . | |
| 3,044,477 | 7/1962 | Higgins | 135/98 |
| 3,794,054 | 2/1974 | Watts . | |
| 3,929,146 | 12/1975 | Maiken | 135/98 |
| 4,033,366 | 5/1977 | Forget . | |
| 4,750,509 | 6/1988 | Kim | 135/98 X |
| 4,865,066 | 9/1989 | Brooks | 135/101 |

*Primary Examiner*—David A. Scherbel
*Assistant Examiner*—Lan Mai
*Attorney, Agent, or Firm*—Venable, Baetjer, Howard & Civiletti

[57] ABSTRACT

The invention provides an improved collapsible tent and tent frame of the umbrella type. The frame includes a plurality of legs pivoted, at the upper ends of the legs, to an upper clevis member. Each leg has pivoted thereto a radial stay member spaced downwardly from the upper end of the leg. The stay member extends inwardly of the tent to be pivoted to the lower clevis. The upper clevis includes a central downwardly opening recess and the lower clevis has fixed thereto an upperwardly projecting post or rod which is adapted to engage the upper clevis so as to stop movement of the lower clevis. Each leg comprises an elongated lower section which can be relatively stiff. The upper end of the lower section is pivoted to an upper section which is relatively flexible and resilient so that the upper portion of the legs can conform to the dome of the sheet material forming the tent cover or ceiling.

15 Claims, 3 Drawing Sheets

COLLAPSIBLE TENT AND FRAME THEREFOR

This invention provides an improved collapsible tent and tent frame. More particularly of the type commonly called an umbrella tent.

BACKGROUND OF THE INVENTION

Umbrella tents have long been known and widely used. Collapsible umbrella tents of various types go back at least to the turn of this century and have usually included a collapsible frame on which the fabric or other flexible sheet material of the tent is supported when the tent has been erected The term "umbrella tent" is commonly used in the trade because the frames for such tents can be erected and collapsed in much the same manner as an umbrella. Typical tents of this type are shown, for example, in the following U.S. Pat. Nos.: 1,079,757, Gould; 1,124,420, Gough; 1,666,757, Snyder; 3,000,386, Schulze et al; 3,794,054, Watts; 4,033,366, Forget. Though such tents have achieved considerable popularity and commercial success, there has been a continuing need for improvement.

SUMMARY OF THE INVENTION

Considered broadly, tents according to the invention are of the umbrella type and comprise a collapsible frame including a plurality of legs pivoted at their upper ends to an upper clevis member. At points spaced downwardly from their upper ends, each leg has pivoted thereto a radial stay member extending inwardly of the tent to be pivoted to a lower clevis The upper clevis includes a central downwardly opening recess. The lower clevis has fixed thereto an upwardly projecting post or rod adapted to engage the upper clevis so as to stop upward movement of the lower clevis. Each leg comprises an elongated lower section which can be relatively stiff and the upper end of the lower section is pivoted to an upper section which is relatively flexible and resilient so that the upper portions of the legs can conform to the dome of the sheet material forming the tent cover. The sheet material advantageously can include a complete or partial floor portion and the lower ends of the legs of the frame engage the floor when the tent is erected. Advantageously, the legs and stays of the frame are of extruded polymeric tubing. The clevis members are molded from polymeric material, as are all of the pivotal connector members of the frame. In the drawings, which form a part of this specification, FIG. 1 is a semi-diagrammatic view of a tent and tent frame according to one embodiment of the invention showing the tent as erected;

DETAILED DESCRIPTION OF THE INVENTION

Figure 1:
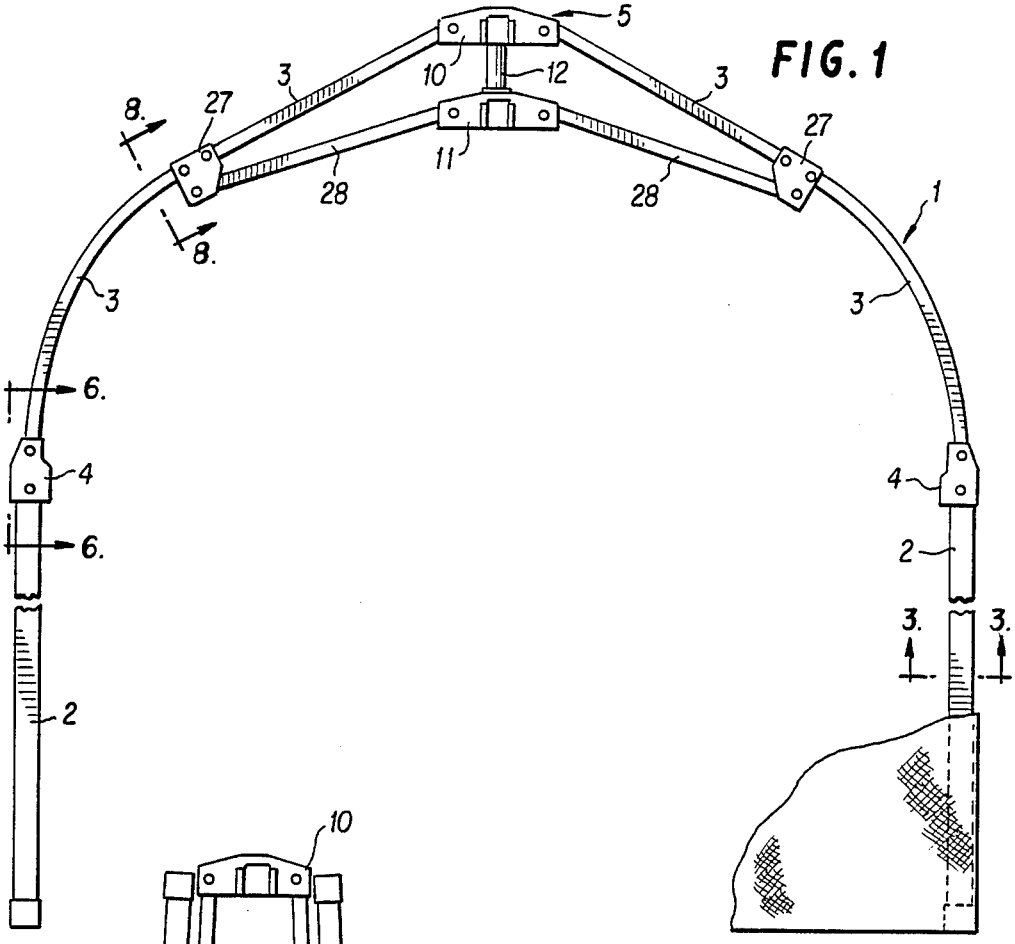
FIG. 1.

In the particularly advantageous embodiment of the invention illustrated, tent frame 1 comprises four legs each comprising a lower section 2 and an upper section 3, the two sections being pivotally connected by a pivot connector 4 and the upper section being pivoted to the upper clevis member of a clevis assembly 5. Leg sections 2 and 3 are hollow extrusions of suitable polymeric material, typically polyvinyl chloride. Pivot connectors 4 are also of polymeric material and are advantageously formed by injection molding from glass fiber-reenforced polyester composition.

Figure 3:
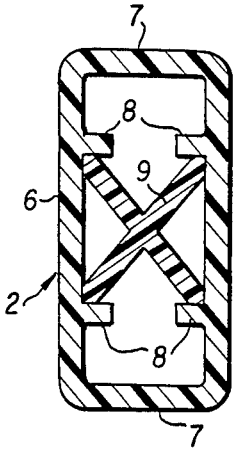
FIG. 3 is a transverse cross-sectional view, on larger scale than FIG. 1, taken generally on line 3—3.

The upper and lower leg sections are identical and, as seen in FIG. 3, have transverse cross sections which in the form of an elongated rectangle having longer sides 6 and shorter sides 7. Inwardly projecting flanges 8, projecting from the longer sides and spaced apart equally from the center of the rectangle, are provided. Throughout its length, each leg section has a reenforcing insert 9 having a transverse cross section in the form of a right angle cross, the edges of the inserts being engaged respectively in the junctures between of flanges 8 with the side walls of the rectangular leg sections.

Lower leg sections 2 are disposed with the long sides of their rectangular cross sections directed inwardly of the tent so that these sections are relatively stiff against forces directed inwardly from outside of the tent frame. Upper leg sections 3 are disposed with the longer sides of their rectangular cross sections at right angles to the long sides of the rectangles of the cross sections of the lower leg sections so that the upper leg sections can more readily bend to follow the curvature necessary to lead to the upper clevis member of clevis assembly 5.

Figure 4:
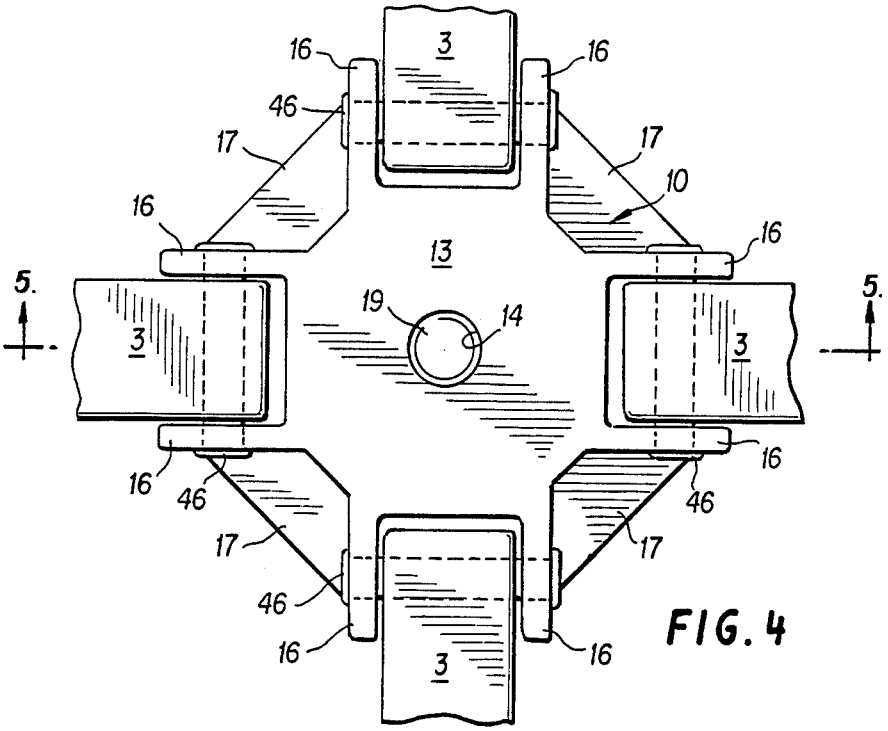
FIG. 4 is a top plan view of the clevis assembly of the tent frame.

Advantageously, clevis assembly 5 comprises an upper clevis member 10, a lower clevis member 11 identical to member 10, and a center post 12. Each clevis member comprises a main body 13 having a central through opening 14 and a downwardly opening generally cup-shaped recess 15. Spaced clevis flanges 16 project radially outwardly from main body 13. At the bottom of the main body, reenforcing flanges 17 interconnect the adjacent flanges 16, as seen in FIG. 4.

Figure 5:
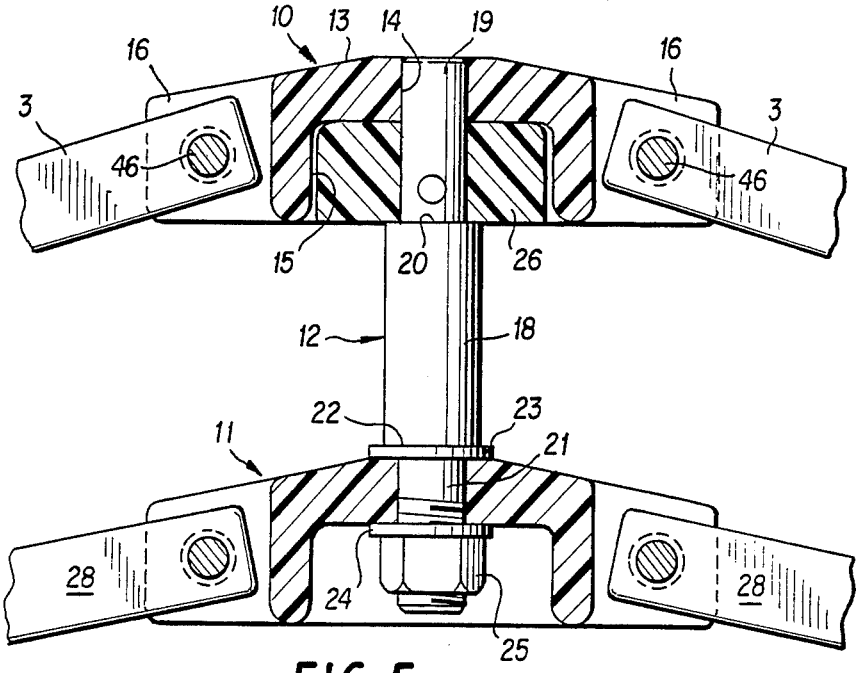
FIG. 5 is a longitudinal sectional view, with some parts shown in elevation, taken generally on line 5—5, FIG. 4.

As best seen in FIG. 5, center post 12 has a main body 18 of larger diameter, an upper end 19 of smaller diameter joining body 18 in upwardly directed shoulder 20, and a smaller diameter lower portion 21 which joins main body 18 at downwardly facing shoulder 22 and is threaded at its lower end. Lower portion 21 extends downwardly through the central opening of lower clevis member 11 and is secured to that member by the combination of upper washer 23, lower washer 24 and nut 25, as seen in FIG. 5. Seated on upper shoulder 20 is a stop member 26 dimensioned and shaped to fit slidably within the downwardly opening recess 15 of the upper clevis member.

Figure 8:
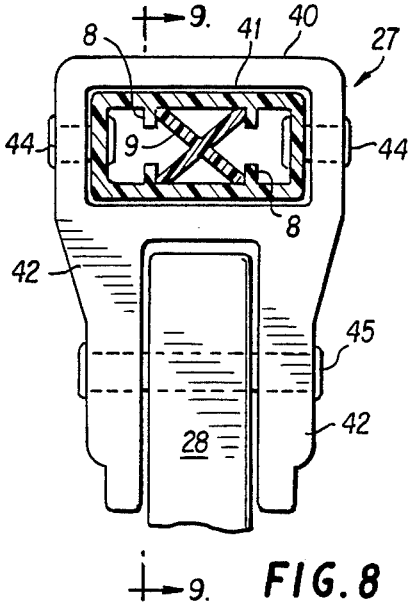
FIG. 8 is a cross-sectional view taken generally on line 8—8, FIG. 1, with some parts shown in elevation.
Figure 9:
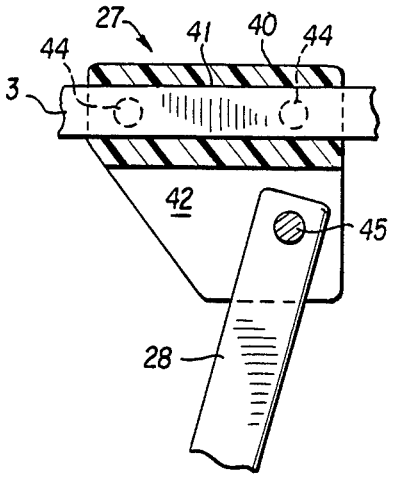
FIG. 9 is a cross-sectional view taken generally on line 9—9, FIG. 8 and on smaller scale than FIG. 8.

At a point intermediate its length, each upper leg section 3 is provided with a pivot member 27, FIGS. 8 and 9, and radial brace members 28 each have one end pivoted to one of members 27 and the other end pivoted between one set of flanges 16 of lower clevis member 11. The positions of members 27 and the length of members 28 are such that when the tent is erected as seen in FIG. 1 lower clevis member 11 is forced upwardly, bringing stop member 26 fully into the recess 15 so that member 26 is stopped by clevis member 10 with portion 19 of center post 12 received in through bore 14 of the upper clevis member.

Figure 2:
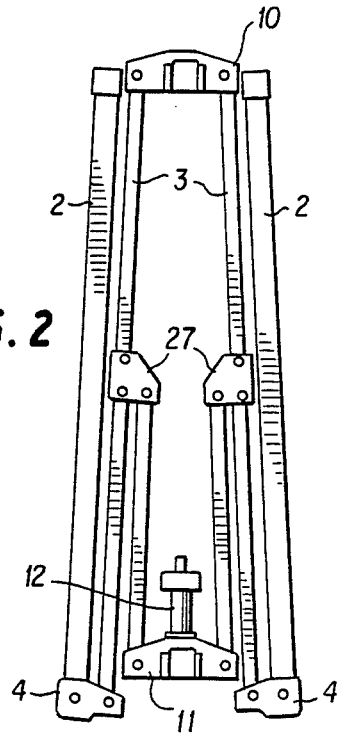
FIG. 2 is a side elevational view, with some parts deleted for clarity of illustration, of the tent of FIG. 1 in folded condition.
Figure 6:
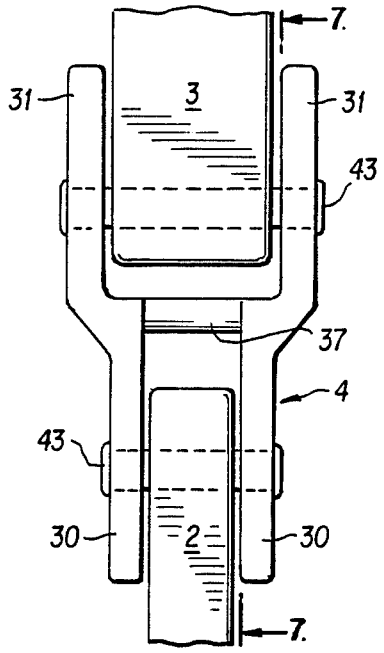
FIG. 6 is an enlarged elevational view taken generally on line 6—6, FIG. 1.
Figure 7:
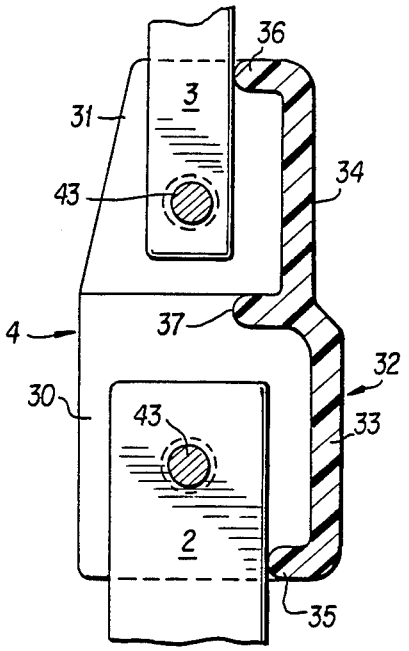
FIG. 7 is a sectional view taken generally on line 7—7, FIG. 6, with some parts shown in elevation.

As seen in FIGS. 6 and 7, pivot connectors 4 are of generally U-shaped transverse cross section, side wall portions 30 being spaced apart by a smaller distance than side wall portions 31 so that the right angle displacement between leg portions 2 and 3 can be accommodated in the manner shown. As seen in FIG. 7, the bottom wall 32 has a first portion 33 and a second portion 34 and these portions are displaced from the pivotal axes of leg members 2 and 3 by distances such that taking into consideration the 90° displacement between the leg portions, the leg portions are freely pivotable between the positions shown in FIGS. 1 and 2. Advantageously, an upstanding rib 35 is provided at the free end of portion 33 and a rib 36 is provided at the free end of portion 34, the heights of these ribs being such that, with parts positioned as seen in FIG. 1, the end portions of the leg portions engage the respective ribs in the manner seen in FIG. 7. A reenforcing rib 37 is advantageously provided at the juncture between portions 33 and 34, as seen in FIG. 7.

Members 27 are identical and are advantageously cut from extruded lengths having the cross-sectional configuration seen in FIG. 8. Each member 27 has a base portion 40 with a through bore 41 which is rectangular transverse cross section and dimensioned to slidably accommodate upper leg portion 3. Members 27 have flanges 42 which are parallel and spaced apart by a distance adequate to freely accommodate one end portion of one of the brace members 28.

Leg portions 2 and 3 are pivoted to members 4 by pivot pins 43 in any suitable manner. Members 27 are fixed to leg portions 3 by pins 44. Brace members 28 are pivoted to flanges 42 by pins 45. The upper ends of leg portions 3 are pivoted to flanges 16 of upper clevis member 10, as by pivot pins 46. The ends of brace members 28 are likewise pivoted to lower clevis member 11 by pivot pins 47, FIG. 5.

Figure 3A:
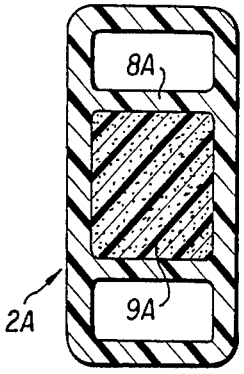
FIG. 3A is a view similar to FIG. 3 illustrating a modification.

It will be apparent that various changes and modifications can be made without departing from the scope of the invention as defined in the claims. Thus, flanges 8, FIG. 3, can be replaced by partitions 8′, FIG. 3A and reenforcing extrusion 9, FIG. 3, can be replaced by a filling of industrial polymeric foam 9′, FIG. 3A.

What is claimed is:

1. In an umbrella tent frame, the combination of
a plurality of legs each comprising
a lower portion,
an upper portion, and
a pivot connector interconnecting the lower and upper portions;
a clevis assembly comprising
an upper clevis member,
a lower clevis member, and
stop means supported by the lower clevis member and projecting toward the upper clevis member and constructed and arranged to engage the upper clevis member to limit movement of the lower clevis member toward the upper clevis member; a plurality of radial pivot members each fixed to a different one of the upper leg portions; and
a plurality of brace members each having one end pivoted to one of the radial pivot members and the other end pivoted to the lower clevis member
wherein each of the leg portions is in the form of a hollow tubular polymeric extrusion; and
wherein the leg portions have transverse cross sections in the form of a rectangle with longer sides and shorter sides, the longer sides of the cross sections of the lower leg sections extending toward the interior of the tent frame when the frame is erected.

2. The combination defined in claim 1, wherein the shorter sides of the cross sections of the upper leg portions extend toward the interior of the tent frame when the frame is erected, whereby the upper leg portions can bend more freely toward the upper clevis member as the tent frame is erected.

3. The combination defined in claim 2, wherein the pivot connectors interconnecting the lower and upper leg portions are each in the form of an integral polymeric piece of generally U-shaped transverse cross section and the side walls thereof include portions spaced more closely together to accommodate the lower leg portion and portion spaced more widely to accommodate the upper leg portion.

4. An umbrella tent of claim 3 wherein said upper clevis member comprises a downwardly opening socket adapted to receive a post member extending from the lower clevis member.

5. An umbrella tent of claim 2 wherein said upper clevis member comprises a downwardly opening socket adapted to receive a post member extending from the lower clevis member.

6. An umbrella tent frame of claim 1 wherein said lower leg portions further comprise means to engage a floor portion of a tent when the tent frame is erected.

7. An umbrella tent of claim 6 wherein said upper clevis member comprises a downwardly opening socket adapted to receive a post member extending from the lower clevis member.

8. An umbrella tent frame of claim 1 wherein said clevis members are molded from polymeric material.

9. An umbrella tent of claim 8 wherein said upper clevis member comprises a downwardly opening socket adapted to receive a post member extending from the lower clevis member.

10. An umbrella tent frame comprising
a plurality of legs each including a lower leg portion and an upper leg portion,
the leg portions being in the form of polymeric extrusions having transverse cross sections in the form of a rectangle having longer sides and shorter sides, the lower and upper leg portions being pivotally interconnected with the longer sides of their cross sections at right angles to each other.

11. An umbrella tent frame of claim 10 further comprising a clevis assembly comprising an upper clevis member and a lower clevis member, and wherein the upper leg portion is connected to the upper clevis member, and wherein the shorter sides of the cross sections of the upper leg portions extend toward the interior of the tent frame when the frame is erected, whereby the upper leg portions can bend more freely toward the upper clevis member as the tent frame is erected.

12. An umbrella tent frame of claim 11 further comprising pivot members interconnecting the lower and upper leg portions and wherein the pivot connectors interconnecting the lower and upper leg portions are each in the form of an integral polymeric piece of generally U-shaped transverse cross section and the side walls thereof include portions spaced more closely together to accommodate the lower leg portion and a portion spaced more widely to accommodate the upper leg portion.

13. An umbrella tent frame of claim 11 wherein said clevis members are molded from polymeric material.

14. An umbrella tent of claim 11 wherein said upper clevis member comprises a downwardly opening socket adapted to receive a post member extending from the lower clevis member.

15. An umbrella tent frame of claim 10 wherein said lower leg portions further comprise means to engage a floor portion of a tent when the tent frame is erected.

* * * * *